United States Patent [19]

King

[11] Patent Number: 4,610,726

[45] Date of Patent: Sep. 9, 1986

[54] DENSE CERMETS CONTAINING FINE GRAINED CERAMICS AND THEIR MANUFACTURE

[75] Inventor: Harry L. King, Hudson, Ohio

[73] Assignee: Eltech Systems Corporation, Boca Raton, Fla.

[21] Appl. No.: 626,451

[22] Filed: Jun. 29, 1984

[51] Int. Cl.[4] ..... C22C 29/12

[52] U.S. Cl. ..... 75/233; 75/234; 75/235; 75/244; 75/254; 204/242; 204/292; 419/12; 419/19; 419/23; 419/38; 419/39; 419/42; 419/45; 419/57; 419/66; 419/68

[58] Field of Search ..... 419/12, 19, 68, 42, 419/38, 23; 501/96; 75/232–235, 244, 254; 204/242, 292

[56] References Cited

U.S. PATENT DOCUMENTS

| | | | |
|---|---|---|---|
| 4,022,584 | 5/1977 | Rudy | 75/234 |
| 4,381,931 | 5/1983 | Hunold et al. | 419/2 |
| 4,431,448 | 2/1984 | Merzhanov et al. | 75/238 |
| 4,492,670 | 1/1985 | Mizrah et al. | 419/9 |
| 4,528,120 | 7/1985 | Hunold et al. | 419/38 |
| 4,540,475 | 9/1985 | DeAngelis | 204/67 |

OTHER PUBLICATIONS

U.S. patent application Ser. No. 454,671, 12301982, DeAngelis.

U.S. patent application Ser. No. 454,718, 12301982, Sane.

U.S. patent application Ser. No. 580,532, 02151984, Fresnel.

*Primary Examiner*—Stephen J. Lechert, Jr.

*Attorney, Agent, or Firm*—John J. Freer

[57] ABSTRACT

A cermet is produced by providing a bulk reaction mixture of particulate reactants plus elemental metal, which reaction mixture is in admixture with a ceramic diluent that is the same as ceramic material formed during sintering of the reaction mixture. Sintering produces a boride-oxide ceramic with the oxide being a metal oxide of the elemental metal. However, the elemental metal is present in the reaction mixture in substantial excess over that amount stoichiometrically required. Sintering is conducted under inert atmosphere, generally after pressing. The invention is particularly directed to boride-based ceramics containing aluminum, which materials are suitable as components of electrolytic cells for the production of aluminum by molten salt electrolysis.

27 Claims, No Drawings

DENSE CERMETS CONTAINING FINE GRAINED CERAMICS AND THEIR MANUFACTURE

BACKGROUND OF THE INVENTION

Oxide-boride ceramics and their application as cell components in electrolytic aluminum production cells have been disclosed in as yet unpublished U.S. patent applications Ser. No. 454,671 and Ser. No. 454,672 now U.S. Pat. No. 4,540,475. In one example from the application Ser. No. 454,671, a particulate reaction mixture in appropriate stoichiometric amounts for producing titanium diboride and alumina was prepared from titanium dioxide, boron oxide and aluminum. The mixture was hot pressed to form the reaction-sintered alumina-titanium diboride composite. Such reaction-sintered composites are taught to be wettable and resistant to molten aluminum and are therefore suitable for insertion into an aluminum production cell for use as a component which may contact the molten aluminum but preferably remains out of contact with molten cryolite.

It has also been proposed to produce ceramic, which contain metal, by starting with porous ceramic bodies. Such bodies may then be infiltrated with molten metal. Thus in the as yet unpublished U.S. patent application Ser. No. 454,718, it has been suggested to prepare a porous matrix of reaction sintered alumina and titanium diboride. This matrix can then be infiltrated by a molten metal such as molten aluminum to prepare the ceramic with infiltrated metal phase.

More recently in the as yet unpublished U.S. patent application Ser. No. 580,532 it has also been disclosed to prepare ceramic-metal composites (cermets) which may be based upon boride-oxide ceramic. Thus for example in an alumina-titanium diboride composite, excess aluminum over stoichiometric can be present in the reaction mixture and thereby provide residual aluminum metal after sintering. The sintering reaction is carried out with the bulk reaction mixture in contact with molten metal, e.g., molten aluminum, which can thereby supply further aluminum to the ceramic body. The sum of all of this aluminum, plus the reaction sintering, achieves the cermet preparation. Also, some preformed ceramic can be present in the reaction mixture prior to sintering, and thereby later reside in the cermet.

It would however be most desirable to use not only inexpensive reactants but also to achieve economy of operation to produce a cermet by straightforward operation.

SUMMARY OF THE INVENTION

A method has now been found for producing cermets, using economy of reactants, which cermets can include those which are wettable and resistant to molten aluminum. The cermets are desirably fine grained, dense bodies that have enhanced dimensional stability. Moreover, the cermets of the present invention can be efficiently prepared in straightforward manner. The reaction mixtures for the present invention are most desirably well balanced to yield dense, stable product even under the aggressive exothermic reaction of the mixture. The cermets formed are suitable for use as a component in contacting molten aluminum and furthermore can be tolerant of contact with molten cryolite.

The present invention is most particularly directed to the method of producing a ceramic-metal composite (cermet) containing boride-oxide ceramic having components of a first metal boride and a second metal oxide, which ceramic is in mixture in the cermet with elemental metal of the second metal. The cermet is produced by sintering a reaction mixture of first metal oxide, boron oxide and elemental second metal, where there is more particularly combined with the reaction mixture ceramic component in very finely divided form and there is admixed with the reaction mixture very finely divided elemental second metal in an amount of at least a 100 percent molar excess beyond that amount stoichiometrically required to produce the second metal oxide during sintering, and then conducting the sintering reaction of such mixture in inert gas atmosphere.

The invention is also especially directed to reaction mixtures particularly adapted for carrying on the methods of the present invention.

DESCRIPTION OF THE PREFERRED EMBODIMENTS

The ceramic-metal composite, or cermet, may also be referred to herein as the "reaction product". It will contain ceramic boride and ceramic oxide material, which will often be referred to herein for convenience as the "boride-oxide ceramic". Each of the boride and oxide in the ceramic will be metal boride and metal oxide. The metals of the boride are most typically the refractory hard metals and more generally will be the Group IVb metals titanium, zirconium and hafnium, Group Vb metals vanadium, niobium and tantalum, and Group VIb metals chromium, molybdenum and tungsten. However, other metals, such as yttrium, or cerium and other lanthanides, as well as the actinides, may also be useful. As supplied for reaction, the metal for preparing the metal boride of the ceramic will be present as an oxide, e.g., $TiO_2$, $Ce_2O_3$ and the like. With the metal oxide there will also be supplied boron oxide, which for purposes of economy will most always be $B_2O_3$. Thus, for convenience, the boron source will be referred to herein as boron oxide and reactions and formulae when shown hereafter will reference boron oxide as $B_2O_3$, although it is to be understood that such are illustrative and not limiting, since, for example the use of boric acid is also contemplated.

The amount of the metal oxide plus the boride for reaction will be selected in conformity with the stoichiometric requirements for preparing the resulting metal boride. For example, 3 moles of titanium dioxide will be selected along with 3 moles of boron oxide to prepare 3 moles of titanium diboride. Although variations to the strict adherence of such stoichiometric requirements may be used, it is preferred for economy and product stability that stoichiometry be followed, and that for attaining variations in the resulting cermet, ceramic component be added to the reaction mixture, as will be more particularly discussed hereinbelow.

The elemental metal is another critical constituent of the reaction mixture. A part of the elemental metal will react with the oxygen of the boron oxide and some will react with the oxygen of the metal oxide. As an example of the ceramic produced, the presence of aluminum in the reaction mixture will yield alumina ($Al_2O_3$) in the final product. For a typical reaction mixture processed with the constituents discussed hereinabove, and thus, for now, excluding the ceramic component which will be discussed and illustrated for this reaction hereinbelow, the following reaction would be carried out:

$$3TiO_2+3B_2O_3+(20\text{–}40)Al=3TiB_2+5Al_2O_3+(10\text{–}30)Al$$

However other possible reactions of this nature can be considered with regard to useful constituents for purposes of the present invention. Representative such other reactions include:

$$Ce_2O_3+6B_2O_3+(28-56)Al=2CeB_6+7Al_2O_3+(14-42)Al$$

$$3ZrO_2+3B_2O_3+(20-40)Al=3ZrB_2+5Al_2O_3+(10-30)Al$$

And many other reactions are possible.

Although the foregoing reactions have been illustrated with reference to the use of elemental aluminum in the reaction mixture, other metals may form the ceramic oxide of the reaction product as well as the elemental metal phase of the cermet. Other metals that are useful in such manner and which have suitable melting points include magnesium and tungsten.

Referring now with particular reference to aluminum as illustrative and further to the reaction of titanium dioxide with boron oxide, a molar ratio of $3TiO_2$:3-$B_2O_3$:10Al will yield 3 moles of titanium diboride plus 5 moles of alumina. For purposes of the present invention an at least 100 percent molar excess of the aluminum will be present. The foregoing molar ratio will thus be 3:3:20 and thereby provide 10 moles of aluminum for the metal phase of the cermet. Less than the minimum 100 percent molar excess of elemental metal in the reaction mixture will be insufficient for preparing a desirably dimensionally stable, dense final product. On the other hand, greater than about a 300 percent molar excess of the elemental metal in the reaction mixture, for a molar ratio as above-discussed of 3:3:40, is uneconomical for imparting enhanced stability to the final product. Typically the molar excess of elemental metal will be within the range of from about 150 percent molar excess up to about a 250 percent excess.

As a further necessary constituent, there will be included with the reaction mixture some reaction-produced material. Such material may also be referred to herein most often as "ceramic component" or occasionally as "ceramic diluent". Where aluminum has been used as the elemental metal of the reaction mixture, alumina is a "reaction-produced" substituent, as such term is used herein. The reaction-produced substituent in the reaction mixture may also be the metal boride produced in the boride-oxide component. Mixtures of such boride, together with the oxide, e.g., titanium diboride mixed with alumina, can also be useful. The reaction produced constituent should always be present in substantial amount. When boride is used, this means at least about a 200 percent molar excess of the boride, basis the moles of such boride produced in the reaction, will be added to the reaction mixture. Referencing again the molar ratio discussed above of 3:3:10 for the illustrative titanium oxide, boron oxide and aluminum reaction mixture, such will produce 3 moles of titanium diboride. A 200 percent molar excess would thus be 6 moles. When these 6 moles of titanium diboride are added to the reaction mixture there will be the 6 moles, plus the 3 moles by reaction, for a total of 9 moles in the final product. The use of less than about a 200 percent molar excess will be insufficient for preparing a dense final product of desirably enhanced dimensional stability plus electroconductivity. On the other hand, a greater than about 800 percent molar excess of such metal boride reaction product in the reaction mixture can be uneconomical. On the basis of the foregoing, just-discussed, exemplification it will be appreciated that such 800 percent excess would provide 27 total moles titanium diboride in the final product.

When addition of the oxide ceramic component is used in the reaction mixture, e.g., the use of alumina addition, a substantial amount of this constituent is likewise used. For the oxide, this means an at least about 100 percent molar excess, and such excess can be expected to be serviceable for preparing a desirably economical yet stable reaction product. On the other hand, above about a 500 percent molar excess is avoided. When mixtures of boride and oxide are used, the use of the substantial amounts of each are to be observed for producing the most economical product with enhanced dimensional stability.

It will be understood that the intended use of the product can dictate the selection of the reaction-produced component. As an example, where the cermet is to serve in an electrolytic cell in a function where electroconductivity will be desirable, then the selection of a boride, e.g., zirconium diboride, will be the ceramic component of choice. Where the produced article need only be wettable and preferably economical, for example when used as an electrolytic cell liner, the selection of the oxide for the added ceramic component can be most suitable. For general serviceability, which may include application calling for electroconductivity, it is preferred that the addition of ceramic component be preponderantly the addition of metal boride, i.e., that the metal boride be greater than 50 weight percent of the added substituent if a mixture of boride and oxide is employed. Moreover, where alumina is used for addition, the alpha form is advantageous for reduced volume change of the added substituent during sintering. Preferably for best volume control, alpha alumina is used exclusively for alumina addition.

As representative of molar amounts which may be employed, and with particular reference to an exemplary reaction using titanium dioxide and elemental aluminum for purposes of illustration, with titanium diboride being supplied as the reaction produced substituent, the following reaction stoichiometry can be useful:

$$3TiO_2+3B_2O_3+(20-40)Al+(7-22)TiB_2=(10-25)TiB_2+5Al_2O_3+(10-30)Al$$

For most economical and efficient reaction, the materials selected for the bulk reaction mixture are all very finely divided, most always having all particles passing 325 mesh (U.S. Sieve Series). For best reaction efficiency, it is advantageous that all substituents used in the reaction mixture have average particle size of less than about 45 microns and it is preferred for best efficiency that all particles in the mixture be more finely divided than 40 microns.

All of the particulate ingredients for the reaction mixture can be mixed or blended in any suitable manner known to those skilled in ceramic technology for yielding an intimate, homogeneous mixture of reactant particles, such as ball milling or twin shell blending. The bulk reaction mixture can then be pressed into a self-sustaining body by any of the methods known in the art for use with such mixtures. If desired, such a body can include a binder which can be volatilized prior to the reaction. For economy, a cold isostatic pressing is used for compressing the reaction mixture. It is a particular feature of the present invention that cold isostatic pressing can be most serviceable for use, with the need for other, generally more uneconomical, techniques being dispensed with. However, other techniques may also be employed, e.g., hot isostatic pressing, injection molding, roller pressing, slip casting or dry pressing in a mold. The compression can be handled in stages, for example to form a green body at a low pressure first stage compression. With reference to forming a green body by cold isostatic pressing, a pressure within the range of from about 1 KPSI to about 10 KPSI will be generally suitable for forming such green body. Operations, e.g., machining or drilling of the resultant green body, may be employed before sintering. With reference to cold isostatic pressing, and particularly where a second stage pressing is employed, a pressure of from about 10 KPSI to about 60 KPSI will be most serviceable for preparing the reaction mixture for sintering.

To achieve this sintering, the heating will most always be initiated gradually, especially where binder has been used, to accommodate binder burn-off. When this has been accomplished, a quite rapid temperature increase can be permitted. It is critical that the sintering proceed while the body is surrounded by a non-interferring atmosphere. By the use of this term it is meant that an atmosphere is used which will permit the reaction to take place with there being formed both the metal boride and the metal oxide of the boride-oxide ceramic. Such an atmosphere can most suitably be argon, although helium or mixtures of these gases may also be employed. Nitrogen alone or in a gaseous mixture is also a suitable non-interferring atmosphere, even where aluminum is present as the elemental metal and some aluminum nitride will be formed. This need not be detrimental, and may even be desired, it being understood that not all of the aluminum is to be reacted to the nitride so as to retain the cermet character of the reaction product. The sintering can be carried out at subatmospheric, atmospheric or superatmospheric pressure although atmospheric is preferred.

The non-interferring atmosphere is permitted to surround the sintering reaction mixture, there being no need in the present invention for sintering in a molten metal bath. It is to be understood that the sintering body may be wrapped, e.g., with aluminum foil, and this may cause some residual surface absorption of aluminum. But this is only a slight surface phenomenon, with the reaction still proceeding in an argon or the like atmosphere and not a molten metal bath. The reaction during sintering is very exothermic. However by carrying out the sintering with the molar proportions of the present invention, deleterious effects, such as cracking and development of undesirable porosity in the sintered body can be overcome. The ceramic phase of the cermets produced according to the present invention are strong and desirably pore and crack free. With the addition of reaction-produced ingredient in the preparation of the reaction mixture, the cermets produced will have highly desirable structural strength and where a reaction-produced metal boride ingredient such as titanium diboride has been employed, the cermet can additionally have desirable electroconductivity.

The following example shows a way in which the invention has been practiced, but should not be construed as limiting the invention. In the example, all parts are parts by weight unless otherwise specified.

EXAMPLE

A powder mixture was prepared with 23 weight parts titanium dioxide, 20 weight parts boron oxide, 77 weight parts aluminum, and 80 weight parts titanium diboride together with 8 weight parts of CARBOWAX 200 (Union Carbide) binder thereby providing a molar ratio (exclusive of binder) of $3TiO_2:3B_2O_3:30Al:12TiB_2$. All ingredients in the reaction mixture, again exclusive of binder, had particle size such that all particles were more finely divided than 40 microns. The particulates for the reaction mixture were blended in a twin shell blender and then slurried with the binder in methyl alcohol. The methyl alcohol was evaporated with a rotary vacuum system under a vacuum of 5–12 mm. Hg. and while using a water bath at 50° C. The resulting mixture was uniaxially pressed at 1 KPSI.

The resulting green body was wrapped in heavy aluminum foil and cold isostatic pressed at 30 KPSI into a cylindrical body. The cylinder was placed in an alumina crucible which was placed in an Inconel retort and then the retort was put in a crucible furnace. Under argon purge and at atmospheric pressure, the green body was fired at a temperature of 1000° C. for six hours. After cooling, the cylindrical body was inspected and found to consist of a cermet with titanium diboride-alumina as the ceramic phase and aluminum as the metal phase. A portion of the resulting cylindrical body was immersed in molten aluminum at 1000° C. for 10 hours and showed macroscopic wetting by aluminum and good dimensional stability in such testing. The resulting sintered product was a desirably dense, dimensionally stable body having an actual density of 3.5 grams per cubic centimeter.

I claim:

1. In the method of producing a ceramic-metal composite (cermet) containing boride-oxide ceramic having components of a first metal boride and a second metal oxide, which ceramic is in mixture in the cermet with elemental metal of said second metal, wherein said cermet is produced by sintering a reaction mixture of first metal oxide, boron oxide and said elemental second metal, the improvement comprising, A. combining for said reaction mixture:
- (a) first metal oxide;
- (b) boron oxide;
- (c) ceramic component in very finely divided form; and
- (d) elemental second metal in very finely divided form and in an amount of at least a 100 percent molar excess beyond that amount stoichiometrically required to produce said second metal oxide during sintering; and B. sintering said reaction mixture in inert gas atmosphere.

2. The method of claim 1, wherein said reaction mixture is compacted prior to sintering.

3. The method of claim 2, wherein said compaction is cold isostatic pressing.

4. The method of claim 2, wherein said mixture is compacted at a pressure within the range of from about 10 KPSI to about 60 KPSI.

5. The method of claim 1, wherein said reaction mixture is combined with ceramic component that is at least preponderantly first metal boride component.

6. The method of claim 1, wherein said reaction mixture is combined with ceramic component having average particle size of less than about 45 microns.

7. The method of claim 1, wherein said reaction mixture is combined with a sufficient amount of said first metal boride to provide at least a 200 percent molar excess of said boride in the cermet, basis moles of said boride produced during sintering.

8. The method of claim 1, wherein said reaction mixture is combined with a sufficient amount of said first metal boride to produce up to an 800 percent molar excess of said boride in the cermet, basis moles of said boride produced during sintering.

9. The method of claim 1, wherein said reaction mixture is combined with a sufficient amount of said second metal oxide to provide at least a 100 percent molar excess of said oxide in the cermet, basis moles of said oxide produced during sintering.

10. The method of claim 1, wherein said reaction mixture is combined with a sufficient amount of said second metal oxide to provide up to a 500 percent molar excess of said oxide in the cermet, basis moles of said oxide produced during sintering.

11. The method of claim 1, wherein said reaction mixture is admixed with finely divided elemental second metal having average particle size of less than about 45 microns.

12. The method of claim 1, wherein said reaction mixture is admixed with finely divided elemental second metal selected from the group consisting of aluminum, magnesium, tungsten and their mixtures.

13. The method of claim 1, wherein said reaction mixture is combined with up to a 300 percent molar excess of said elemental second metal beyond that amount stoichiometrically required to produce said metal oxide during sintering.

14. The method of claim 1, wherein said sintering is conducted in non-interferring gas atmosphere and at least substantially at atmospheric pressure.

15. The method of claim 14, wherein said sintering is conducted in an argon-containing atmosphere.

16. The method of claim 1, wherein said reaction mixture is established by mixing together titanium oxide, boron oxide, aluminum and titanium diboride.

17. The method of claim 16, wherein said reaction mixture is established by mixing together substituents in substantially the following molar proportions: $3TiO_2$:3-$B_2O_3$:(20–40) Aluminum:(7–22)$TiB_2$.

18. The method of claim 17, wherein the reaction mixture is sintered at a temperature within the range of from about 650° C. to about 1100° C.

19. A component of an electrolytic cell for the production of metal by molten salt electrolysis, which comprises a cermet produced by the method of claim 1.

20. An electrolytic cell for the production of metal by molten salt electrolysis, comprising a cell component of a cermet produced by the method of claim 1, in which the metal phase of the cermet is the same as the metal to be produced in the cell.

21. In the method of producing a ceramic-metal composite (cermet) containing boride-oxide ceramic having components of a first metal boride and a second metal oxide, which ceramic is in mixture in the cermet with elemental metal of said second metal, wherein said cermet is produced by sintering a reaction mixture of first metal oxide, boron oxide and said elemental second metal, the improvement comprising, combining in said reaction mixture very finely divided ceramic component in an amount sufficient to provide a substantial molar excess of ceramic component in said cermet, basis moles of said component produced during sintering, admixing with said reaction mixture very finely divided elemental second metal in an amount of at least a 100 percent molar excess beyond that amount stoichiometrically required to produce said second metal oxide during sintering, and sintering said reaction mixture in inert gas atmosphere.

22. A reaction mixture adapted for preparing a dense, dimensionally stable ceramic-metal composite (cermet) containing boride-oxide ceramic having components of a first metal boride and a second metal oxide, which ceramic is in mixture in the cermet with elemental metal of said second metal, which reaction mixture comprises:

(a) first metal oxide and boron oxide, in at least substantially stoichiometric proportions for preparing said first metal boride during reaction of said reaction mixture;

(b) elemental second metal in very finely divided form and in an amount of at least a 100 percent molar excess beyond that amount stoichiometrically required to produce said second metal oxide; and (c) ceramic component in very finely divided form and in amount sufficient to provide a substantial molar excess of ceramic component in said cermet, basis moles of said component produced by reaction of said reaction mixture.

23. The reaction mixture of claim 22, wherein said ceramic component is at least preponderantly a first metal boride component.

24. The reaction mixture of claim 22, wherein said first metal oxide is titanium oxide, said elemental second metal is aluminum and said ceramic component is titanium boride component.

25. The reaction mixture of claim 24, wherein said reaction mixture substituents are present in substantially the following molar proportions: $3TiO_2$:$3B_2O_3$:(20–40) Aluminum:(7–22)$TiB_2$.

26. The reaction mixture of claim 22, wherein said elemental second metal and said ceramic component each having average particle size of less than about 45 microns.

27. The reaction mixture of claim 22, wherein said ceramic component is a first metal boride component which is present in an amount sufficient to provide at least a 200 percent molar excess of ceramic component, a basis moles of said component produced by reaction of said reaction mixture.

* * * * *